US005609038A

United States Patent [19]

Halimi

[11] Patent Number: 5,609,038

[45] Date of Patent: Mar. 11, 1997

[54] SELF-CHILLING BEVERAGE CONTAINER AND PARTS THEREFOR

[76] Inventor: Edward M. Halimi, 6155 Carpinteria Ave., Carpinteria, Calif. 93013

[21] Appl. No.: 518,034

[22] Filed: Aug. 22, 1995

[51] Int. Cl.[6] ..... F25D 3/10

[52] U.S. Cl. ..... 62/294; 62/371; 62/457.4

[58] Field of Search ..... 62/294, 371, 457.4, 62/4

[56] References Cited

U.S. PATENT DOCUMENTS

| | | | |
|---|---|---|---|
| 3,494,141 | 2/1970 | Irwin et al. | 62/371 X |
| 3,494,143 | 2/1970 | Barnett et al. | 62/294 |
| 4,688,395 | 8/1987 | Holcomb | 62/294 |
| 5,325,680 | 7/1994 | Baroso-Lujan et al. | 62/294 |
| 5,394,703 | 3/1995 | Anthony | 62/294 X |

*Primary Examiner*—William E. Tapolcai
*Attorney, Agent, or Firm*—Allan M. Shapiro

[57] ABSTRACT

A beverage container such as a can contains pressurized beverage together with a cartridge containing a refrigerant such as carbon dioxide. A cartridge holder holds the cartridge in place by engaging the inside of the can. A cartridge piercer is positioned between the cartridge and the can end. When the can is filled and the end installed, the pressurized beverage releases part of its gs which increases gas pressure within the can. The increasing gas pressure deflects the can ends which are resilient. The released beverage gas also arms and lengthens the cartridge piercer to engage substantially under the deflected can end. When the can pressure is released, the cartridge piercer pierces the cartridge to release the carbon dioxide therein to chill the beverage container and its contents.

24 Claims, 4 Drawing Sheets

FIG. 1
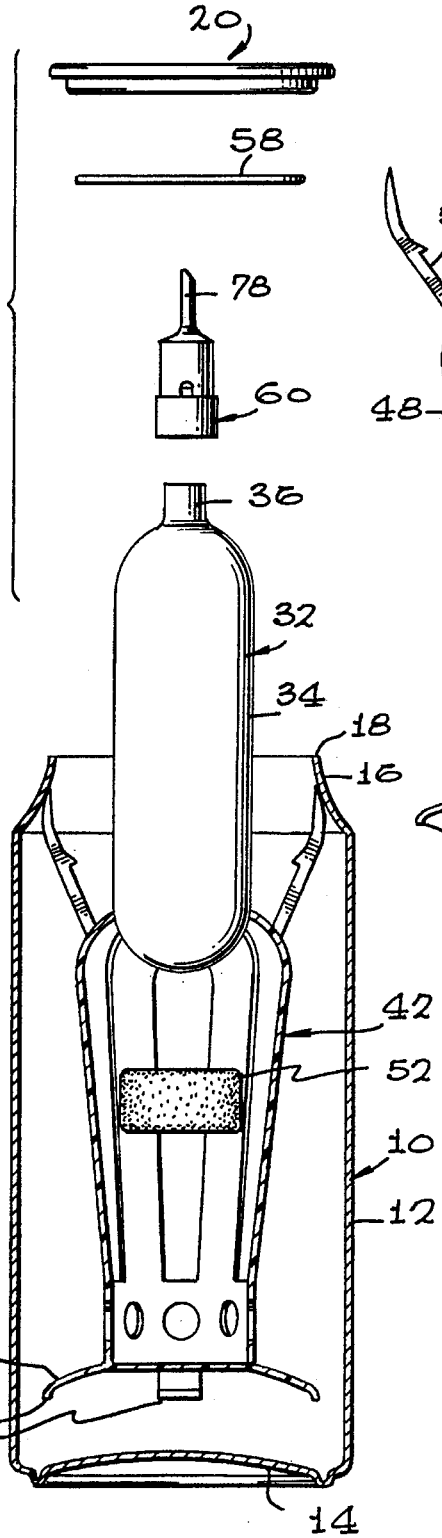
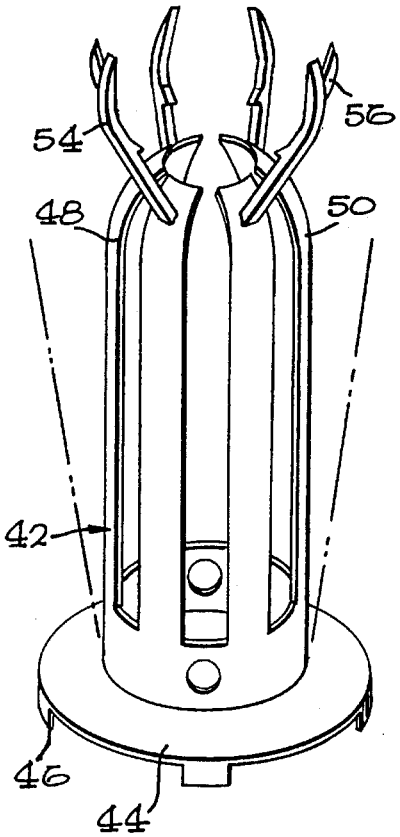
FIG. 3
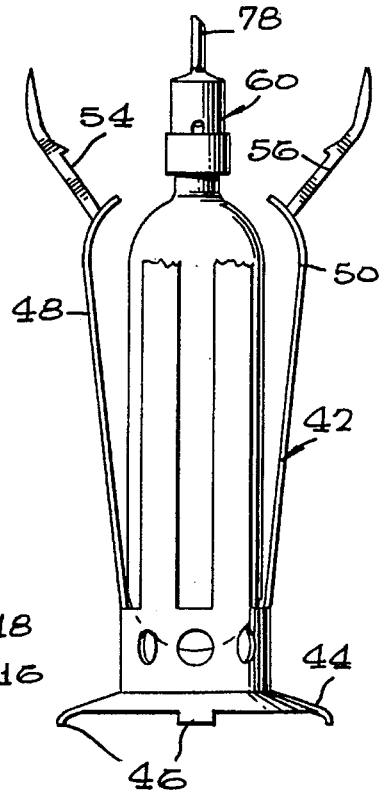
FIG. 2

FIG. 8
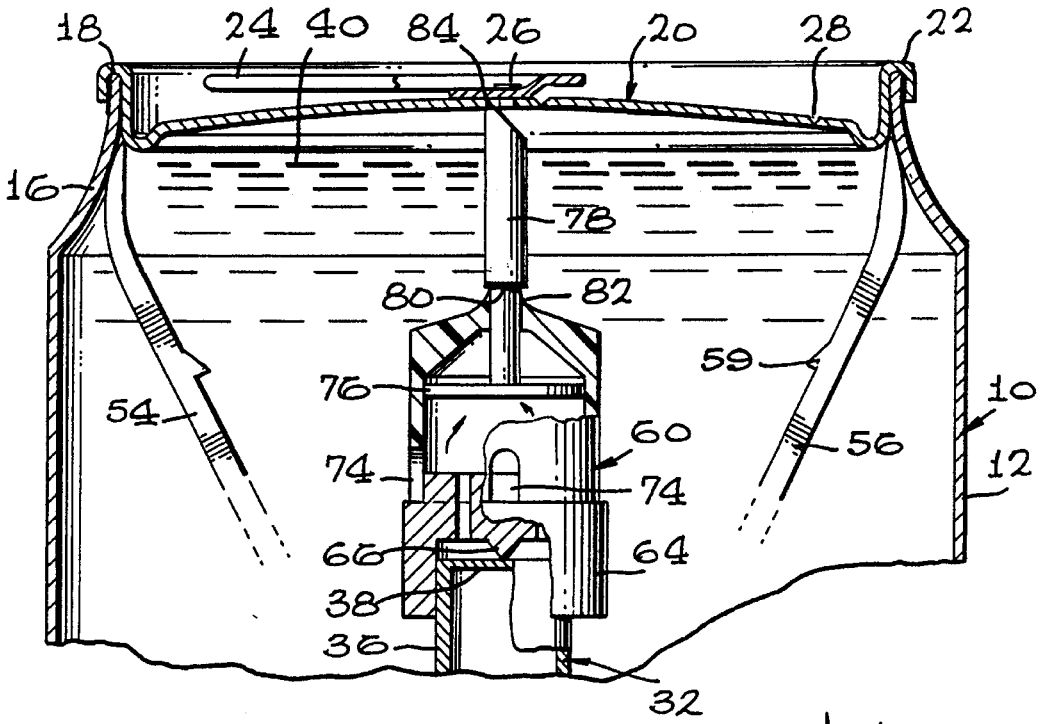
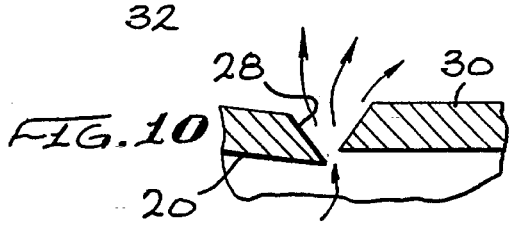
FIG. 10
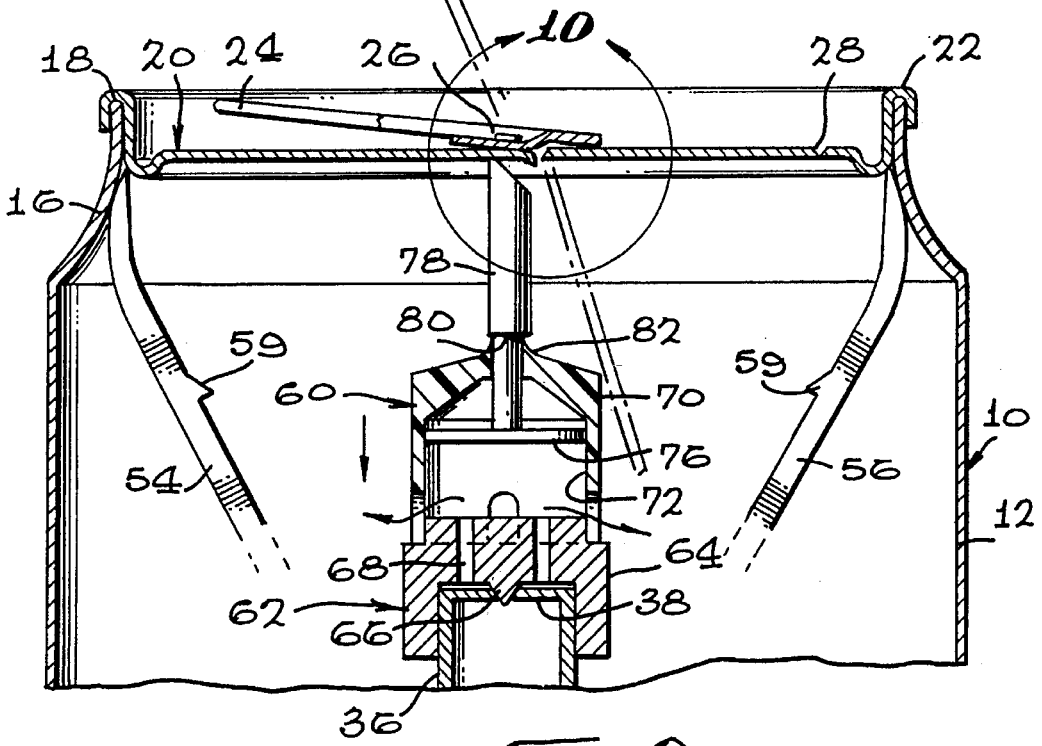
FIG. 9

SELF-CHILLING BEVERAGE CONTAINER AND PARTS THEREFOR

FIELD OF THE INVENTION

This invention is directed to a self-chilling beverage container in which is placed a cartridge of pressurized refrigerant. When the beverage container is opened and the pressurized cartridge is pierced, expanding refrigerant causes cooling.

BACKGROUND OF THE INVENTION

Beverages of various types are provided to the public in metal cans sized for individual servings. In the modern marketplace, the cans are aluminum with the sides and bottom end formed of one piece by stamping. The top end is sealed in place after the can has been filled with its beverage. Most such beverage containers have a lever mounted thereon for stressing the end so that it opens along predetermined lines. When opened, the beverage can be poured into a drinking vessel or may be consumed directly from the can. The beverage in the container may be alcoholic, such as beer, or may be non-alcoholic, such as any of the well-known carbonated soft drinks.

Most consumers prefer that such beverages are chilled. To accommodate this taste of the consumer, such beverage containers are stored in a refrigerator or are poured over ice in a beverage drinking vessel. Those who wish to drink chilled beverage directly out of the beverage container must purchase the beverage container before use and then chill it in a chilled space. At home, this chilled space is usually a refrigerator which is cooled by a separate refrigerant cycle. Away from home, the beverage may be kept in an icebox together with ice. Such is a desirable way of carrying and chilling beverage containers, but it is an inconvenient system because it requires that the presence of ice must be maintained. For more than a short period away from conveniences, such is difficult. Thus, there is need for a self-chilling beverage container.

SUMMARY OF THE INVENTION

In order to aid in the understanding of this invention, it can be stated in essentially summary form that it is directed to a self-chilling beverage container for pressurized beverages. The container includes a refrigerant cartridge containing refrigerant under pressure. A cartridge holder engages the container and retains the cartridge in position. After the can is filled with a gas-containing beverage, the upper can end is sealed onto the can. The can ends, as well as the can Walls, are resilient. After the can is sealed, part of the beverage gas is released within the can which thereby pressurizes the can and resiliently deflects the resilient portions such as the can ends outwardly. A cartridge piercer engages against the pressure deflected resilient portion of the beverage container. When the container is opened, the interior pressure in the beverage container is released, and the resilient portion actuates the piercer to pierce the cartridge to release the refrigerant to thus chill the beverage container and its contents.

It is a purpose and advantage of this invention to provide a self-chilling beverage container which permits a user to open a container when he desires a chilled beverage, to thereupon cause the chilling of the beverage so that he may drink it.

It is a further purpose and advantage of this invention to provide a cartridge holder and a cartridge piercer which can be inserted into a standard beverage can together with the self-pressurizing beverage therein so that, after the end is closed, the structure adjusts to the pressure-deflected condition of the beverage container and, upon release of pressure in the container, the cartridge piercer releases the refrigerant in the cartridge to cool the beverage in the beverage container.

It is a further purpose and advantage of this invention to provide structure which can be incorporated into a standard beverage container so that, after self-pressurizing beverage is placed in the container and the end is sealed thereon, opening of the beverage container causes refrigeration of the beverage therein.

It is a further purpose and advantage of this invention to provide a self-chilling structure which adds minimal cost to a beverage container and which can be applied thereto without changes in the beverage container so that self-chilling beverage containers can be inexpensively supplied to the public and reliably used by the public.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is an exploded view of the self-chilling beverage structure of this invention as it is being inserted into the beverage container.

FIG. 3 is an enlarged view of the cartridge holder in the closed position.

FIG. 4 is an enlarged central section through a beverage container having therein the self-chilling beverage structure of this invention.

FIG. 8 is a section through the beverage container, similar to the top portion of FIG. 4, with parts of the cartridge piercer being broken away and taken in section, in the condition after the beverage container has been filled with self-pressurizing beverage.

FIG. 9 is a view similar to FIG. 8 showing the self-chilling structure in position where the carbon dioxide cartridge is pierced for release of the carbon dioxide refrigerant.

FIG. 10 is an enlarged detail showing the escape of beverage container pressurization.

DESCRIPTION OF THE PREFERRED EMBODIMENTS

Figure 2:
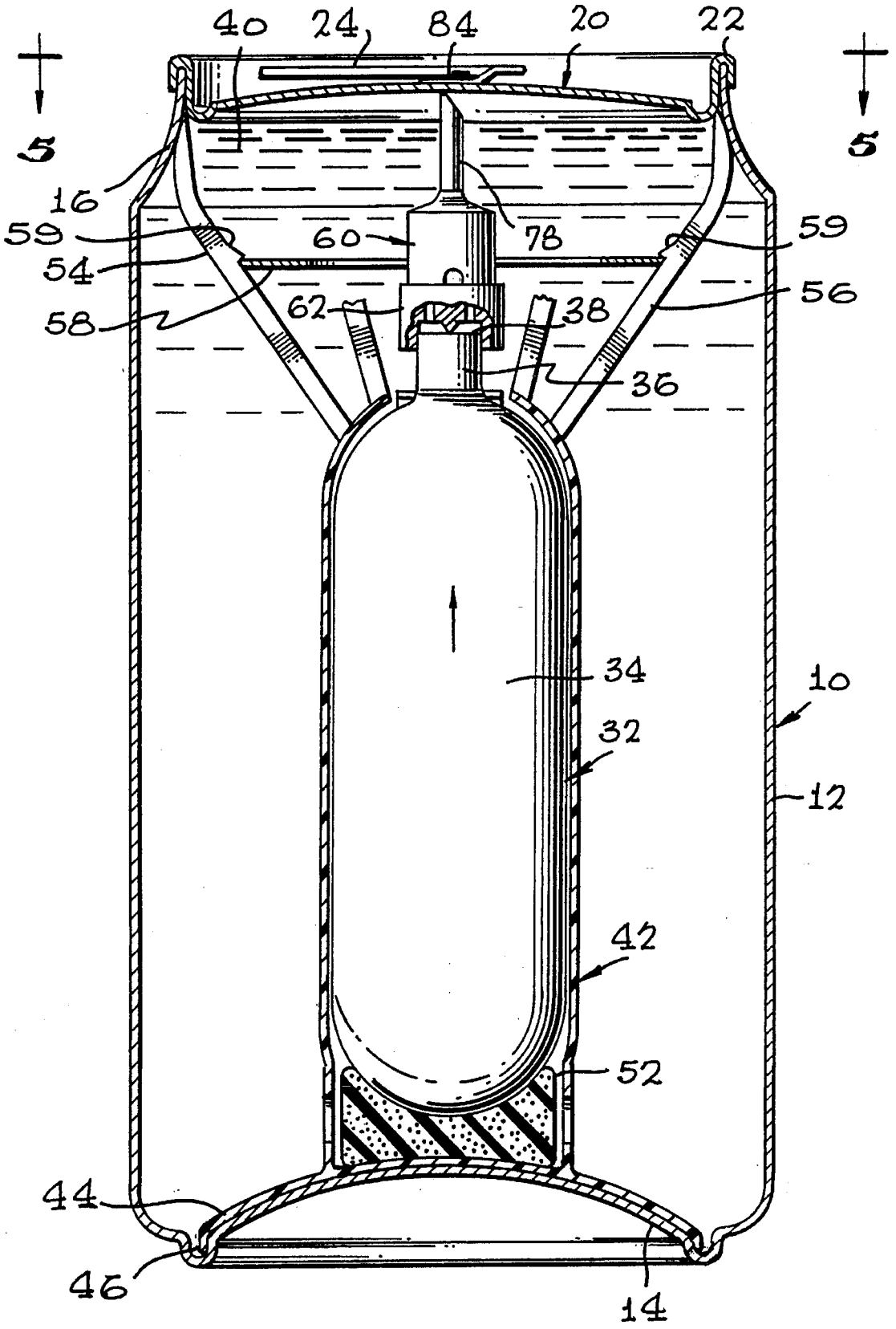
FIG. 2 is a side-elevational view of the cartridge holder in the open position.

The container 10 is shown in centerline section in FIG. 4. It has side walls 12 and integral bottom end 14. The side walls are substantially in the form of a right circular cylindrical tube. The entire container is usually formed in a single die stroke. The bottom end 14 is domed to provide strength thereto in view of the eventual pressurization of the interior of the container. The side walls are in the form of a cylindrical tube and, thus, pressurization of the container causes circumferential tension, which strengthens the container. The upper portion of the side walls is reduced in diameter at neck 16. The side walls terminate at upper edge 18.

Figure 5:
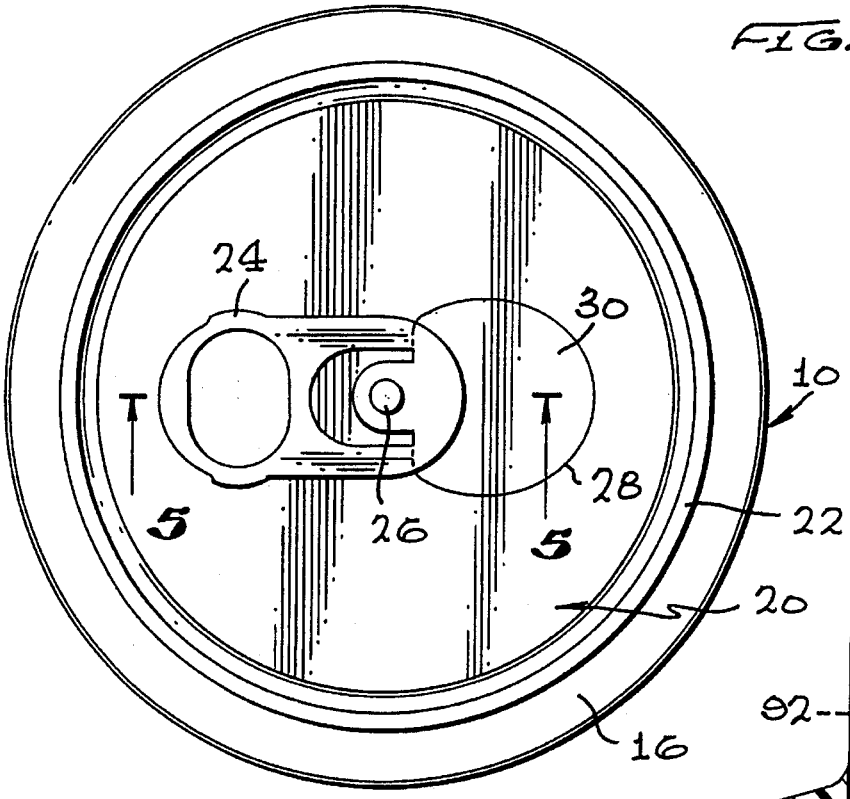
FIG. 5 is a plan view, as seen generally along line 5—5 of FIG. 4.

Upper end 20 has a crimping edge 22. After filling of the container, the upper end is put in place and the container is sealed by crimping the edge 22 onto the upper part of neck 16 adjacent edge 18. Pull tab 24 is mounted on rivet 26, see FIGS. 5, 8 and 9. The rivet 26 may not be a separate rivet as it was in earlier practice, but may be a rivet extruded upward from the material of upper end 28 and headed over pull tab 24. A stress-raising notch 28 is formed as a loop in the top end material, see FIG. 5. The pull tab 24 is configured so that, when the pull tab is raised from the closed position of FIG. 8 to the partially raised position of FIG. 9, the stress applied at the stress-raising notch 28 is sufficient to separate the material to cause the panel 30 to come loose around most of its periphery and bend down into the container to the phantom line position shown in FIG. 9. This operation adjacent the rivet is shown in large detail in FIG. 10. This is conventional practice in present-day aluminum beer cans and pressurized soft drink cans.

Figure 6:
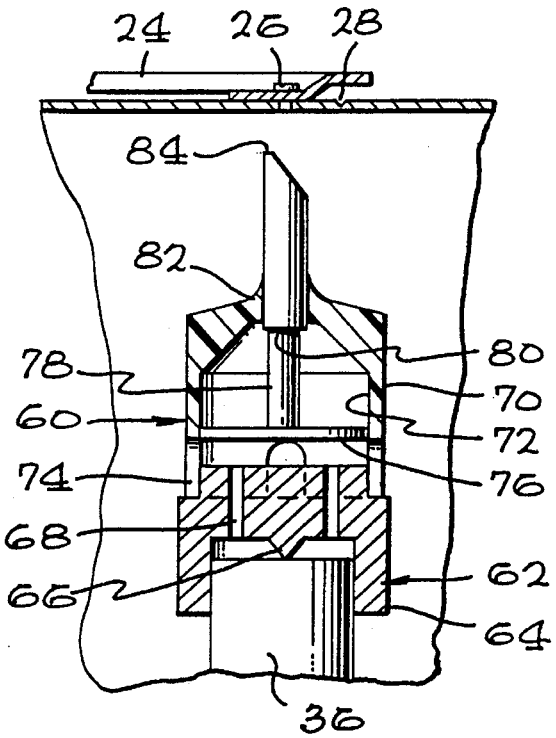
FIG. 6 is an enlarged section through the cartridge piercer in accordance with this invention, in the position wherein it is first placed within the beverage container.

It is important to note that the top end 20 is almost flat when in the unpressurized condition shown in FIGS. 1, 6 and 9. The internal pressurization of the beverage container 10 causes resilient upward deflection of the upper end, which is seen in FIGS. 4 and 8. The conventional beverage container is positioned, filled with beverage which has dissolved carbon dioxide therein, and the top end is put in place and crimped. The outgassing of carbon dioxide from the beverage liquid quickly pressurizes the container and the top end 20 goes to the resiliently deflected, domed position of FIGS. 4 and 8.

Carbon dioxide cartridge 32 is conventional in the marketplace. It has a body 34 which tapers to a neck 36. Conventionally, the body 34 is made of steel because liquid carbon dioxide has a high vapor pressure at room temperature although it can be made of aluminum or alloys. Thus, a substantial pressure must be held. The neck 36 has a pierceable sealing diaphragm 38, see FIGS. 4, 6, 8 and 9. The pierceable sealing diaphragm 38 is usually made of aluminum. Such carbon dioxide cartridges are available for different purposes. It is the carbon dioxide cartridge 32 which, when pierced, supplies the expanding gas which refrigerates the liquid beverage 40 in the container 10.

Carbon dioxide cartridge 32 is positioned within container 10 and held in place by cartridge holder 42 seen in FIGS. 1, 2, 3 and 4. Cartridge holder 42, preferably made of plastic, such as a molded thermoplastic copolymer, has a base 44 which is configured to rest on top of dome 14. The base may have feet 46 which fit down into a corresponding groove at the bottom end. This engagement accurately positions the cartridge holder within container 10. A plurality of arms are mounted on base 44 and extend upwardly therefrom. Arms 48 and 50 are specifically identified in FIG. 3, and from that figure, it can be seen there are six such arms evenly spaced and extending upwardly from the base. These arms are shaped and sized to embrace the cartridge 32, as seen in FIG. 4. In FIG. 2, the arms are separated so that the cartridge 32 can be inserted therebetween. The FIG. 2 position is prior to insertion of the cartridge and cartridge holder into the container. FIG. 1 is an exploded view, but the cartridge is placed in the cartridge holder first before insertion into the beverage container 10. When the cartridge is placed in the cartridge holder, the arms including arms 48 and 50, are bent inward so that they embrace the cartridge.

Closed cell resilient polymer foam pad 52 is positioned within the cartridge holder beneath the cartridge, as seen in FIG. 4. It resiliently thrusts the cartridge upward so that the shoulder of the cartridge around neck 36 is thrust into engagement of the shoulder formed in the corresponding arms. A finger is formed on each of the arms. Fingers 54 and 56 are specifically identified in FIGS. 2, 3 and 4 as being mounted on arms 48 and 50. The fingers are sized so that they can be resiliently deflected to enter into the neck of the container and, in that position, expand to engage on the interior of the container at the neck thereof, as seen in FIGS. 4, 8 and 9. As the cartridge holder with its cartridges is inserted into the can, the arms are held together around the cartridge and, once in the can, the fingers are spread so that their pads engage inside the neck of the container. Retainer ring 58 is positioned inside of the arms and snaps down over retainer projections 59 to hold the arms in the spread position, as shown in FIG. 4. Thus, the cartridge holder and the cartridge are securely positioned within the beverage container.

Cartridge piercer 68 is best seen in FIGS. 6, 8 and 9. Piercer body 62 has a collar 64 which is sized to be slidable on the neck 36 of the carbon dioxide cartridge 32. Interiorly, the body 62 has a piercer point 66 which lies against the top of neck 36 before piercing, as seen in FIGS. 6 and 8. The piercer point pierces the diaphragm 38 to release the carbon dioxide from cartridge 32 when the point is thrust down, as seen in FIG. 9. Vent passages 68 extend upwardly through the body to vent the carbon dioxide gas upward.

Cylinder 70 has a cylinder bore 72 which is sized to engage on a shoulder on the top of piercer body 62. Both the piercer body and the cylinder may be made of polymer composition material. However, the material of the piercer body must be sufficiently hard so that point 66 is rigid enough to accomplish the piercing. Side openings 74 permit the vent of the carbon dioxide from the cylinder when released and also permit communication of the can pressure into the lower part of the cylinder.

Piston 76 is slidable within the cylinder bore 72. Piston rod 78 is secured to the piston and moves therewith. Piston rod 78 has a downward-facing shoulder 80 thereon. When the piston rod is in its lowered position during installation, seen in FIG. 6, this shoulder is within resilient collar 82, which closes the top of the cylinder 70. The piston rod is slidable through this collar, but the collar is resiliently deflected. The collar and shoulder 80 are positioned so that, when the piston 76 moves to the top of its stroke seen in FIG. 8, the collar 82 engages under shoulder 80. Thus, the piston and its piston rod can only make the upward traverse irreversibly from the position of FIG. 6 to the position of FIGS. 4 and 8. The structure is sized so that, when the structure is inserted into the unpressurized beverage container, the end 84 of the piston rod is below the flat can end 20, as seen in FIG. 6. It is in this position when the can is filled.

Liquid beverage 40, which has carbon dioxide gas dissolved into the liquid, is filled into the can, and the upper end 20 is immediately put in place and sealed. The outgassing carbon dioxide quickly pressurizes the can. This pressurization causes two simultaneous results. One is the upward doming of the upper end from the flat position of FIG. 6 to the pressurized position of FIGS. 4 and 8. The other result of the rapidly increasing pressure in the beverage container is that the space in cylinder 70 below piston 76 is pressurized. This forces the piston 76 and its piston rod 78 upward from the position of FIG. 6 to the position of FIGS. 4 and 8. The structure is sized so that the end 84 of the piston rod is against the underside of the domed upper end 20. The cartridge piercer 60 is in its extended position wherein its top end is under the domed upper end, while its piercer point 66 is against the diaphragm 38, as seen in FIG. 8. It is in this condition, with the piercing system armed, that the beverage container is stored and shipped.

The ultimate consumer buys the beverage container in this armed condition and carries it until he has desire for a chilled beverage. To open the beverage container, the user pulls tab 24 upward. The tilting of rivet 26 breaks the adjacent portion of the stress raiser notch 28, and raising of the tab 24 levers downward the area of the upper end 20 which is within the boundaries of the stress-raising notch 28. This permits discharge of the beverage 40 from this newly created opening in upper end 20.

The release of pressure within the beverage container occasioned by the opening of the container causes the resilient downward return of the upper end 20 from the pressure-induced domed position of FIG. 8 to the substantially flat position of FIG. 9. This downward motion of the center portion of the upper end thrusts the entire cartridge piercer downward. The downward force on piston rod 78 is transferred to cylinder 70 by means of shoulder 80. The cylinder 70 thrusts piercer body 62 downward. This downward motion causes piercer point 66 to penetrate the diaphragm 38, as seen in FIG. 9. Piercing of the diaphragm 38 permits the discharge of the carbon dioxide within cartridge 32. The upward flow is through vent passage 68 into cylinder 72 and thence out opening 74. The carbon dioxide bubbles upward through the liquid and is discharged out of the can opening in the end 20. The expansion of the carbon dioxide causes chilling. The expanded carbon dioxide gas coming out of the openings 74 is cold. Furthermore, the expansion causes the carbon dioxide cartridge 32 to become chilled. As seen in FIG. 4, chilling of this cartridge enables absorption of heat from a substantial amount of the liquid beverage in container 10. If the user waits a minute after opening before he drinks his beverage, he will find the beverage is substantially evenly charged. The chilled beverage can be consumed directly from the can, if desired.

In some cases, it is deirable to have greater thrust force on the piercer point 66 than available from the just-described action of the domed can end 20 bearing down on the piston rod 78. In these cases, the foam pad 52 is designed so that the initial pressurization of the beverage container causes compression deflection of the foam pad 52, thereby storing energy in the pad. Thus, when the can end 20 is released, the foam pad 52 decompresses and provides an upward thrust against the cylinder 34, whereby the cylinder diaphragm 38 is effectively thrust upward against the piercer point 66. Furthermore, the bottom domed end 14 is deflected downwardly when the container is pressurized, thus storing additional potential energy for release and consequent upward thrust against the cylinder 34 and its diaphragm 38.

Figure 7:
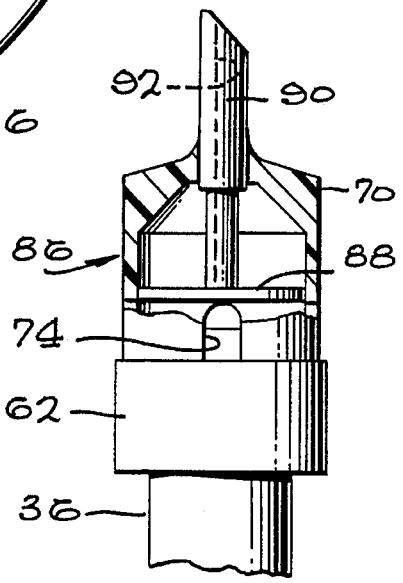
FIG. 7 is a second preferred embodiment of the cartridge piercer.

In some cases, it may be desirable to minimize the amount of carbon dioxide being directly mixed into the liquid beverage. The mixing of too much carbon dioxide therein may cause undesirable foaming. The cartridge piercer 86 of FIG. 7 has the same body 62 and the same cylinder 70. In the cartridge piercer 86, the piston 88 is on a piston rod 90, which has a carbon dioxide passage 92 through the length thereof. When the cartridge piercer 86 is used and carbon dioxide is discharged from the cartridge, a substantial amount of it passes upward through passage 92 and, at the top of piston 90, it passes directly out of the container. The side openings 74 are present in the cylinder 70 but, with this upper relief passage 92, as much less of the carbon dioxide is discharged into the beverage as is desired. Thus, the potential for foaming is minimized.

This invention has been described in its presently contemplated best modes, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A self-chilling beverage container comprising:

walls and ends, including at least one separate end for defining a beverage container, so that said beverage container can be filled with a self-pressurizing beverage and said separate ends sealed thereon to close said container, at least a portion of said container being a deflectable portion which is resiliently deflected by pressurization of said container;

a pressurized refrigerant cartridge, said cartridge having a diaphragm thereon which can be punctured for release of refrigerant within said cartridge to cause cooling by refrigerant expansion, said refrigerant cartridge being in thermal communication with beverage within said container so that cooling of said cartridge causes cooling of beverage within said container; and a piercer adjacent said diaphragm, said piercer being engaged with said container so that when said deflectable portion of said container is released from its deflected position by release of pressurization of said container, said piercer pierces said diaphragm to release refrigerant from said cartridge to cause cooling of beverage in said container.

2. The self-chilling beverage container of claim 1 wherein said deflectable portion is an end of said container.

3. The self-chilling beverage container of claim 2 wherein said container has an end which is integrally formed with said walls and has said separate end of said container, said separate end of said container being said deflectable portion.

4. The self-chilling beverage container of claim 1 wherein said piercer has first and second parts, said first part being a piercer body which carries a piercer point thereon and said second part being extendable away from said piercer point so that said piercer can be placed into a beverage container in which said deflectable portion is undeflected and said second portion can extend with respect to said first portion when said deflectable portion is deflected.

5. The self-chilling beverage container of claim 4 wherein said deflectable portion is an end of said container.

6. The self-chilling beverage container of claim 5 wherein said refrigerant cartridge and said piercer are positioned within said beverage container and rest on a portion of said beverage container way from said deflectable portion.

7. The self-chilling beverage container of claim 4 wherein said second part has a piston thereon, said piston being pressurized by pressurization of said container to extend said second part with respect to said piercer.

8. The self-chilling beverage container of claim 1 wherein said piercer comprises a body and a piercing point on said body, said body being slidable with respect to said pressurized refrigerant cartridge with said piercer point adjacent said diaphragm on said pressurized refrigerant cartridge;

an extendable member movably mounted with respect to said body, said movable member being positioned adjacent said deflectable portion of said container; and means for causing said movable member to irreversibly move with respect to said body when said resiliently deflectable portion is deflected by pressurization of said container so that depressurization of said container causes piercing of said diaphragm to release refrigerant in said cartridge.

9. A self-chilling beverage container comprising:

walls and ends defining a closeable pressurizable beverage container, at least one of said walls and ends being a deflectable portion which is resiliently deflected upon pressurization of said container;

a cartridge for containing pressurized refrigerant, said cartridge having a diaphragm for release of pressurized refrigerant from said cartridge, said cartridge being in thermal communication with said beverage container so that upon release of refrigerant from said cartridge, beverage in said beverage container is cooled; and means responsive to said resiliently deflectable portion for piercing said cartridge diaphragm for release of refrigerant from said cartridge when said beverage container is depressurized causing return of said deflectable portion.

10. The self-chilling beverage container of claim 9 wherein said means for piercing comprises a cartridge piercer having a piercing point thereon substantially in contact with said diaphragm and a member thereon substantially in contact with said resiliently deflectable portion so that release of pressure within said beverage container causes said member to force said piercing point into said diaphragm.

11. The self-chilling beverage container of claim 10 wherein said member is irreversibly movable away from said piercing point.

12. The self-chilling beverage container of claim 11 wherein said piercer has a cylinder therein and a piston within said cylinder, said piston being connected to said member so that pressurization adjacent said piston causes movement of said member.

13. The self-chilling beverage container of claim 12 wherein said piercer is within said beverage container and pressurization of said beverage container moves said piston to move said member toward said deflectable portion as said deflectable portion deflects so as to irreversibly extend said member away from said piercing point as said container is pressurized.

14. The self-chilling beverage container of claim 13 wherein said member is a piston rod which extends out of said piercer and there is inter-engagement means between said piercer and said piston rod for permitting irreversible motion of said piston rod out of said piercer.

15. A self-chilling beverage container comprising:

walls and first and second ends defining a beverage container which can be filled with a beverage containing dissolved carbon dioxide through an open end followed by closing and sealing said open end to form a pressurizable beverage container, said first and second ends being resiliently deflectable away from each other by pressurization of said beverage container;

a carbon dioxide filled refrigerant cartridge within said pressurized container, said cartridge being mounted on said second end; and piercer means for piercing said carbon dioxide refrigerant cartridge engaged on said cartridge and being positioned substantially against said resiliently deflected first end for piercing said carbon dioxide refrigerant cartridge to release carbon dioxide refrigerant therefrom upon depressurization of said beverage container so that beverage in said container is chilled.

16. The self-chilling beverage container of claim 15 wherein said piercer includes a piercing point adjacent said carbon dioxide refrigerant cartridge and a member adjacent said deflectable end, said piercer being irreversibly movable to lengthen the distance between said piercer point and said member.

17. The self-chilling beverage container of claim 16 wherein said member is a piston rod and there is a piston positioned within said piercer and connected to said piston rod, said piston rod and said piston being movable with respect to said piercer to extend the distance between said point and said piston rod as pressure rises within said beverage container at the same time pressure is deflecting said end.

18. The self-chilling beverage container of claim 17 wherein said piercer includes a cylinder within which said piston slides and includes a collar around said piston rod, said collar engaging said piston rod for irreversible movement of said piston rod away from said piercer point.

19. The self-chilling beverage container of claim 18 wherein there is a cartridge holder within said beverage container, said cartridge holder engaging and retaining said cartridge and said cartridge holder being supported on said second end of said beverage container.

20. The self-chilling beverage container of claim 19 wherein said cartridge holder has fingers thereon, said fingers being sized and positioned to engage within said beverage container to retain said cartridge holder against said second end.

21. The self-chilling beverage container of claim 19 wherein said cartridge holder is configured and sized to fit into the open end of a beverage container, engage within said beverage container on said second end of said beverage container for support therein.

22. Parts for placement in a beverage container having an open first end and a closed second end together with an end for closing said first open end of said beverage container, said parts comprising:

a cartridge holder for holding a cartridge of compressed refrigerant with respect to one of said ends;

a piercer engaged between a cartridge in said cartridge holder and the other of said ends, said piercer having a piercer point and a member for actuating said piercer point, said member being configured to irreversibly move away from said piercer point when said piercer is pressurized by the increase of pressure within the beverage container when the beverage container is filled with pressurizing beverage and the first end of the container is closed, said piercer being configured to pierce a pressurized refrigerant cartridge when the beverage can is depressurized.

23. Parts for placement in a beverage container having an open first end and a closed second end together with an end for closing said first open end of said beverage container, said parts comprising:

a cartridge holder for holding a cartridge of compressed refrigerant with respect to one of said ends;

a piercer engaged between a cartridge in said cartridge holder and the other of said ends, said piercer being formed of a piercer body having a piercer point thereon for engagement with a pressurized refrigerant cartridge for the piercing thereof and a movable member which is irreversibly movable away from said piercing point.

24. Parts for placement in a beverage container having an open first end and a closed second end together with an end for closing said first open end of said beverage container, said parts comprising:

a cartridge holder for holding a cartridge of compressed refrigerant with respect to one of said ends;

a piercer engaged between a cartridge in said cartridge holder and the other of said ends, said piercer being formed of a piercer body having a piercer point thereon for engagement with a pressurized refrigerant cartridge for the piercing thereof and a movable member which is irreversibly movable away from said piercing point, said movable member being for engagement by the beverage container for moving said piercing point for piercing of the pressurized refrigerant cartridge, said movable member having a piston thereon for moving said movable member away from said piercing point upon pressurization of the beverage container.

* * * * *